US012135162B2

(12) United States Patent
Jeon et al.

(10) Patent No.: US 12,135,162 B2
(45) Date of Patent: Nov. 5, 2024

(54) REFRIGERATOR

(71) Applicant: LG Electronics Inc., Seoul (KR)

(72) Inventors: Woojin Jeon, Seoul (KR); Myeongseong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/224,923

(22) Filed: Jul. 21, 2023

(65) Prior Publication Data

US 2023/0358461 A1 Nov. 9, 2023

Related U.S. Application Data

(63) Continuation of application No. 17/508,247, filed on Oct. 22, 2021, now Pat. No. 11,732,952.

(30) Foreign Application Priority Data

Oct. 23, 2020 (KR) ..... 10-2020-0138266

(51) Int. Cl.
*F25D 23/02* (2006.01)

(52) U.S. Cl.
CPC ..... *F25D 23/025* (2013.01); *F25D 2323/023* (2013.01)

(58) Field of Classification Search
CPC ..... F25D 23/025; F25D 2323/023; F25D 23/028; F25D 23/04; F25D 23/02;
(Continued)

(56) References Cited

U.S. PATENT DOCUMENTS 2,942,438 A * 6/1960 Schmeling ..... F25D 23/04 62/377
3,086,830 A * 4/1963 John ..... F25D 23/04 62/448

(Continued)

FOREIGN PATENT DOCUMENTS

EP 3608614 2/2020
KR 10-2015-0074285 7/2015

(Continued)

OTHER PUBLICATIONS

Extended European Search Report in European Appln. No. 21204136.2, dated Mar. 31, 2022, 7 pages.

*Primary Examiner* — Hiwot E Tefera
(74) *Attorney, Agent, or Firm* — Fish & Richardson P.C.

(57) ABSTRACT

A refrigerator includes a cabinet, a main door having an opening, a sub-door rotatably provided in front of the main door to open and close the opening and filled with a heat insulating material, a locking member protruding from the sub-door to the main door and operated to lock the main door, an operation member provided below the locking member and protruding downward from a lower portion of the sub-door to be directly operated by a user, a connection member connecting the locking member and the operation member such that the locking member operates when the operation member operates, and a connection member case provided inside the sub-door and defining a space in which the connection member is operatively accommodated. The connection member case is formed with a reinforcement part extending in an upper-and-lower direction along the connection member case to prevent deformation of the connection member.

20 Claims, 14 Drawing Sheets

(58) Field of Classification Search
CPC .... E05B 65/0042; E05B 1/0038; E05B 65/06; E05C 7/02; E05C 3/06; E05C 1/12
See application file for complete search history.

(56) References Cited

U.S. PATENT DOCUMENTS

| | | | | |
|---|---|---|---|---|
| 11,359,414 | B2 * | 6/2022 | Ayyawar | E05C 7/02 |
| 2013/0033163 | A1 * | 2/2013 | Kang | F25D 23/04 312/405.1 |
| 2013/0169139 | A1 | 7/2013 | Jung et al. | |
| 2015/0069900 | A1 | 3/2015 | Lim et al. | |
| 2015/0176886 | A1 | 6/2015 | Lee et al. | |
| 2015/0241116 | A1 | 8/2015 | Choi et al. | |
| 2018/0202707 | A1 | 7/2018 | Park | |
| 2018/0335245 | A1 | 11/2018 | Lee et al. | |
| 2019/0120542 | A1 | 4/2019 | Kim et al. | |
| 2019/0331400 | A1 | 10/2019 | Park | |
| 2019/0338999 | A1 * | 11/2019 | Lee | E05C 1/12 |
| 2020/0370818 | A1 | 11/2020 | Lee et al. | |
| 2020/0386010 | A1 * | 12/2020 | Lv | E05B 15/0093 |
| 2021/0239386 | A1 | 8/2021 | Yong et al. | |
| 2021/0364221 | A1 | 11/2021 | Yeom | |
| 2021/0372689 | A1 | 12/2021 | Park | |
| 2022/0260304 | A1 * | 8/2022 | Ham | E05C 9/08 |

FOREIGN PATENT DOCUMENTS

| | | |
|---|---|---|
| KR | 10-2017-0119923 | 10/2017 |
| KR | 102093435 | 3/2020 |
| WO | WO 2021091067 | 5/2021 |

* cited by examiner

REFRIGERATOR

CROSS-REFERENCE TO RELATED APPLICATIONS

The present application is a continuation of U.S. application Ser. No. 17/508,247, filed on Oct. 22, 2021, which claims priority under 35 U.S.C. 119 and 35 U.S.C. 365 to Korean Patent Application No. 10-2020-0138266, filed on Oct. 23, 2020, which are hereby incorporated by reference in their entirety.

BACKGROUND

The present disclosure relates to a refrigerator.

In general, refrigerators are home appliances for storing foods at a low temperature in an internal storage space that is shielded by a door. To this end, the refrigerator is configured such that foods are stored in an optimal state, by cooling the inside of the storage space using cold air generated through heat exchange with refrigerant circulating in a refrigeration cycle.

Recently, refrigerators tend to be gradually enlarged and multifunctionalized according to changes in diet and enhancement of products, and refrigerators including various structures and convenience devices for user convenience and efficient use of an internal space have been released.

In Korean Patent Laid-Open No. 10-2015-0074285, an opening is formed in a main door of a refrigerator, a sub-door for opening and closing the opening of the main door is provided, and the sub-door includes a latch member locked with the main door, an operation member operated by a user, a connection member connecting the operation member and the latch member and a connection member guide in which the connection member is accommodated in the sub-door.

However, in the related art, the long connection member guide may be deformed or may deviate from an initial mounting position by a heat insulating material injected during a process of manufacturing a door. When the connection member guide is deformed or deviates from the initial mounting position, it may be difficult to normally open the sub-door.

SUMMARY

An embodiment of the present disclosure provides a refrigerator capable of ensuring reliability of a sub-door opening operation.

An embodiment of the present disclosure provides a refrigerator capable of firmly maintaining the mounting position of a connection member case.

An embodiment of the present disclosure provides a refrigerator capable of preventing a connection member case from being deformed and enabling smooth operation of a connection member.

A refrigerator according to an embodiment of the present disclosure may include a cabinet defining a storage space, a main door rotatably mounted on the cabinet to open/close the storage space and having an opening penetrated in a front-and-rear direction, a sub-door rotatably provided in front of the main door to open/close the opening and filled with a heat insulating material, a locking member protruding from the sub-door to the main door and operated to lock the main door, an operation member provided below the locking member and protruding downward from a lower portion of the sub-door to be directly operated by a user, a connection member connecting the locking member and the operation member such that the locking member operates when the operation member operates, and a connection member case provided inside the sub-door and defining a space in which the connection member is operatively accommodated. The connection member case may be formed with a reinforcement part extending in an upper-and-lower direction along the connection member case to prevent deformation of the connection member.

The reinforcement part may continuously extend from an upper end and to a lower end of the connection member case.

An internal space of the connection member case may be formed larger than an outer diameter of the connection member.

The reinforcement part may include an inner reinforcement part formed along an inner surface of the connection member case.

A plurality of inner reinforcement parts may protrude toward an outer surface of the connection member.

The reinforcement part may include an outer reinforcement part protruding along an outer surface of the connection member case.

A circumferential surface of the connection member case may be formed in a polygonal shape to be in contact with an inner surface of the sub-door, and the reinforcement part may protrude from the circumferential surface toward a front surface of the sub-door and the reinforcement part may be formed in a curved shape.

A pair of case fixing parts may protrude from an inner surface of the sub-door in a state of being separated from each other to lock both sides of the outer surface of the connection member case.

A locking member accommodation part recessed from a rear surface of the sub-door and defining a space in which the locking member is operatively accommodated and an operation member accommodation part recessed from the lower surface of the sub-door and defining a space in which the operation member is operatively accommodated may be formed, and the connection member case may be inserted into a lower surface of the locking member accommodation part and an upper surface of the operation member accommodation part.

A lower surface of the locking member accommodation part may be formed with an upper mounting part in contact with an upper circumference of the connection member case, and an upper surface of the locking member accommodation part may be formed with a lower mounting part in contact with a lower circumference of the connection member case.

The connection member case may have the same cross-sectional shape from an upper end to a lower end.

The connection member case may be extruded from a plastic material and the reinforcement part is formed together.

The refrigerator may further include a locking member bracket provided in the sub-door and having the locking member mounted thereon rotatably, and a locking member spring connecting the locking member bracket and the locking member and providing elastic force upon rotation of the locking member.

The refrigerator may further include a connection member spring having the connection member penetrating therethrough and providing elastic force upon operation of the connection member.

The connection member may be formed in a rod shape extending vertically, a lower end of the connection member may be in contact with the operation member and may vertically move upon rotation operation of the operation member, and an upper end of the connection member may be in contact with the locking member and may rotate the locking member upon vertical movement of the connection member.

The upper end of the connection member may be coupled with an upper cap in contact with the locking member and the lower end of the connection member may be coupled with a lower cap in contact with the operation member, and the upper cap and the lower cap may be formed of a softer material than the connection member, the locking member and the operation member.

The connection member may be formed with a vertically extending rod and a rod guide protruding along a circumference of the rod and protruding toward an inner surface of the connection case.

The rod guide may be formed in a ring shape and may have the rod penetrating therethrough, and a plurality of rod guides may be mounted along the rod.

The rod may be formed of a metal material and the rod guide may be formed of a material different from that of the rod.

A handle for allowing a user to put their hand to pull a door for rotation of the sub-door may be recessed and formed in a lower surface of the sub-door, and the handle and the operation member may be located side by side.

DETAILED DESCRIPTION OF THE EMBODIMENTS

Hereinafter, specific embodiments of the present disclosure will be described in detail with reference to the drawings. However, the present disclosure is not limited to the embodiments according to the spirit of the present disclosure and other embodiments included in the scope of the present disclosure or the other disclosure may be easily proposed by addition, change, or deletion of other elements.

Prior to a description, directions are defined. In the embodiments of the present disclosure, a direction which a front surface of a door shown in FIG. 2 faces may be a front direction, a direction from the front surface of the door to a cabinet may be a rear direction, a direction of the floor on which a refrigerator is installed may be a lower direction, and a direction away from the floor may be an upper direction.

In general, a refrigerator may be divided into various types according to a division form of a storage space and arrangement and structure of doors. Hereinafter, although a refrigerator in which a storage space is divided into upper and down portions for convenience of description and understanding, the present disclosure is not limited thereto and is applicable to all types of refrigerators having doors. In particular, the present disclosure is applicable to a structure in which a storage space is divided into left and right portions and is opened or closed by each door.

Figure 1:
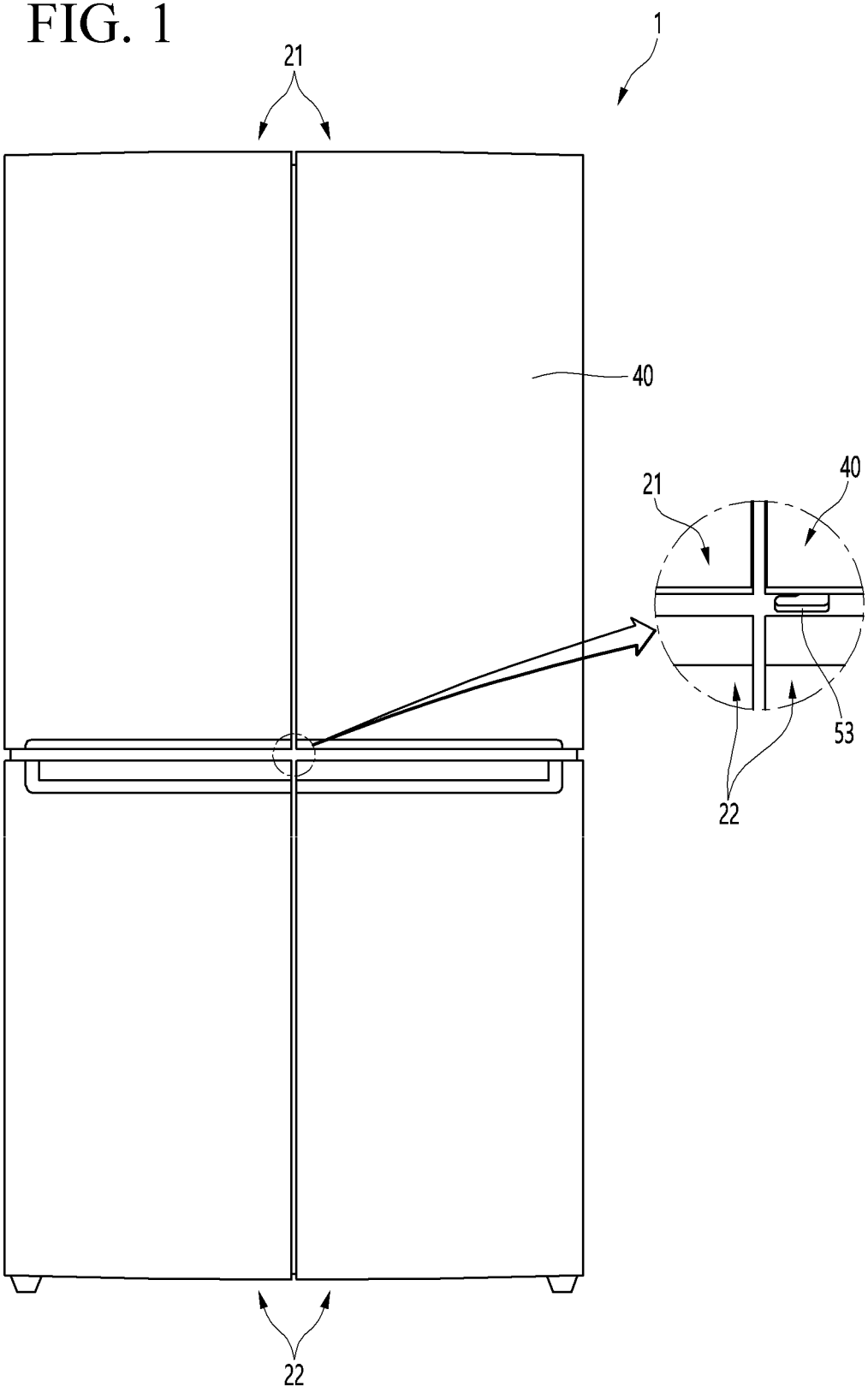
FIG. 1 is a front view of a refrigerator according to an embodiment of the present disclosure.
Figure 2:
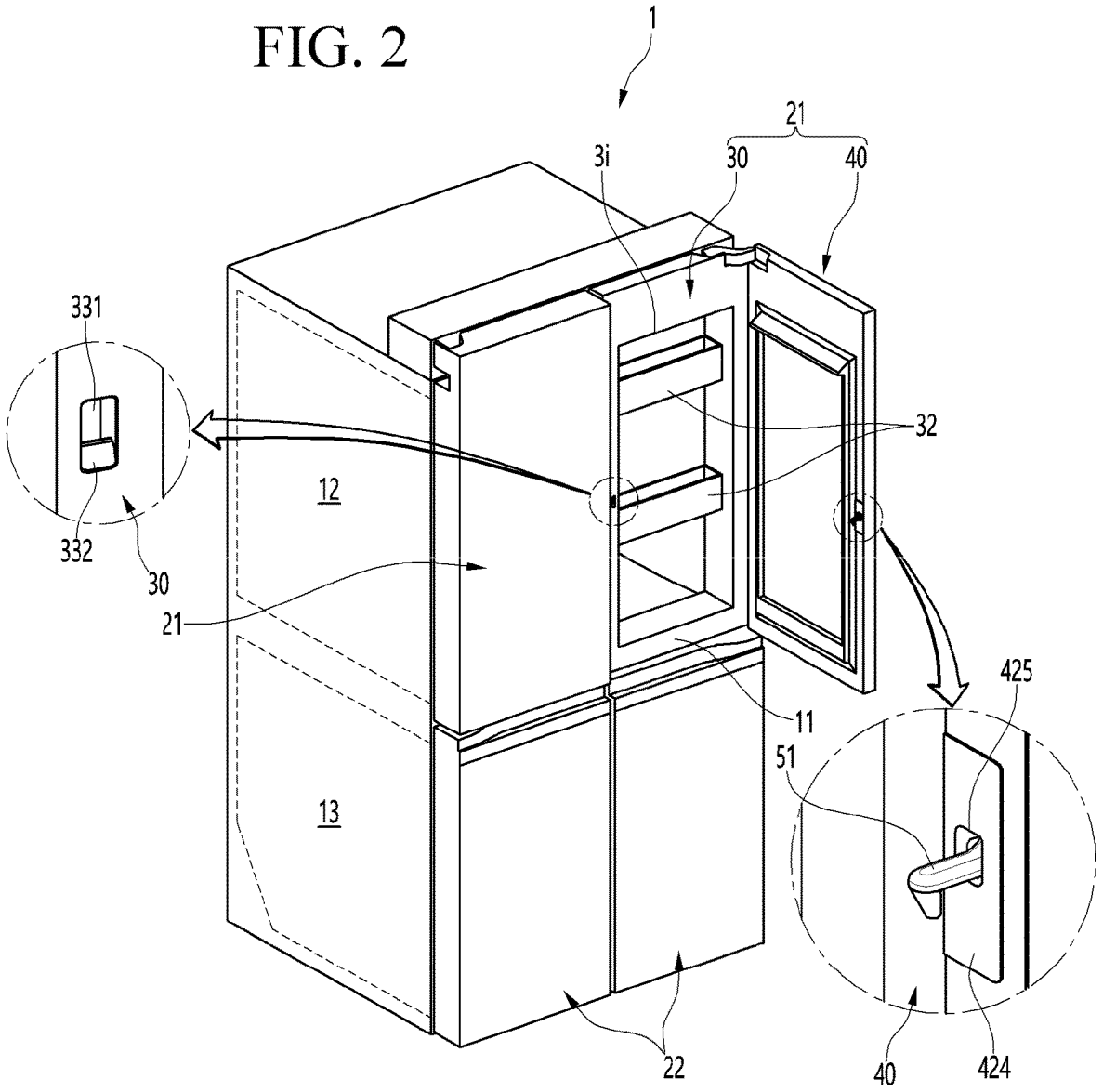
FIG. 2 is a perspective view illustrating a state in which a sub-door of the refrigerator is open.

FIG. 1 is a front view of a refrigerator according to an embodiment of the present disclosure. FIG. 2 is a perspective view illustrating a state in which a sub-door of the refrigerator is open.

As shown, a refrigerator 1 according to the embodiment of the present disclosure may have an overall appearance formed by a cabinet 10 defining a storage space and doors 21 and 22 for opening and closing the cabinet 10.

The cabinet 10 may include a barrier 11 partitioning the storage space into upper and lower portions. Accordingly, the storage space may be divided into an upper storage space 12 and a lower storage space 13. In addition, the upper storage space 12 and the lower storage space 13 may be controlled to have independent temperatures. For example, the upper storage space 12 may be used as a refrigerating compartment with a relatively high frequency of use, and the lower storage space 13 may be used as a freezing compartment.

The doors 21 and 22 may be configured to open and close the storage space, and may include an upper door 21 for opening and closing the upper storage space and a lower door 22 for opening and closing the lower storage space 13.

A pair of upper doors 21 and a pair of lower doors 22 may be arranged on both the left and right sides and may be configured to be opened and closed by rotation. That is, the upper storage space 12 may be opened/closed by the pair of upper doors 21, and the lower storage space 13 may be opened and closed by the pair of lower doors 22.

In addition, at least one of the upper doors 21 may have a double door structure (door-in-door structure). For example, the right upper door 21 of the upper doors 21 may include a main door 30 for opening and closing the upper storage space 12 and a sub-door 40 rotating in the same direction as the main door 30 at the front side of the main door 30. The left door of the upper door 21 and the lower doors 22 may also have the double door structure and an opening/closing assembly 50 described below may be disposed.

A opening 31 may be formed in the main door 30. The opening 31 may penetrate through the main door 30 in the front-and-rear direction, and may be formed to occupy most of an area except for the circumference of the main door 30. In addition, the opening 31 may communicate with the inside of the upper storage space 12, and a separate storage device such as a door basket 32 may be provided in the opening 31.

In addition, the sub-door 40 may be disposed in front of the main door 30, and may be rotatably mounted on the main door 30. Accordingly, the opening 31 may be opened and closed by rotation of the sub-door 40.

The sub-door 40 may have the same horizontal width and vertical width as the main door 30. Accordingly, the sub-door 40 may be seen as being formed integrally with the main door 30 in a state of being closed, and may be seen as being configured as a single door when viewed from the front side.

In addition, the main door 30 may be provided with a locker 331 for maintaining the sub-door 40 in a closed state. The locker 331 may be formed in a recessed groove shape, and a locking protrusion 332 may be formed in an inner lower surface of the locker 331. In a state in which the sub-door 40 is closed, a locking member 51 described below may be inserted into the locker 331 and locked to the locking protrusion 332, thereby maintaining the sub-door 40 in the closed state.

The locker 331 may be located at a position facing the locking member 51. That is, the locker 331 may be formed at one end far from a rotation axis C of the main door 30 between the left and right sides of the front surface of the main door 30, that is, a left end of FIG. 2. In addition, the locker 331 may be located at a middle point of the vertical length of the main door 30, thereby maintaining the sub-door 40 in a stable closed state.

Meanwhile, the sub-door 40 may be provided with an opening/closing assembly 50 for opening the sub-door 40. In particular, the locking member 51 configuring the opening/closing assembly 50 may protrude from the rear surface of the sub-door 40, and may be located at a position facing the locker 331. In this case, the locking member 51 may pass through a cover hole 425 of an accommodation part cover 424 shielding a locking member accommodation part 422 to protrude, and an end of the locking member 51 may protrude to be inserted into the locker 331 in a state in which the sub-door 40 is closed.

Hereinafter, the structure of the sub-door 40 will be described in greater detail with reference to the drawings.

Figure 3:
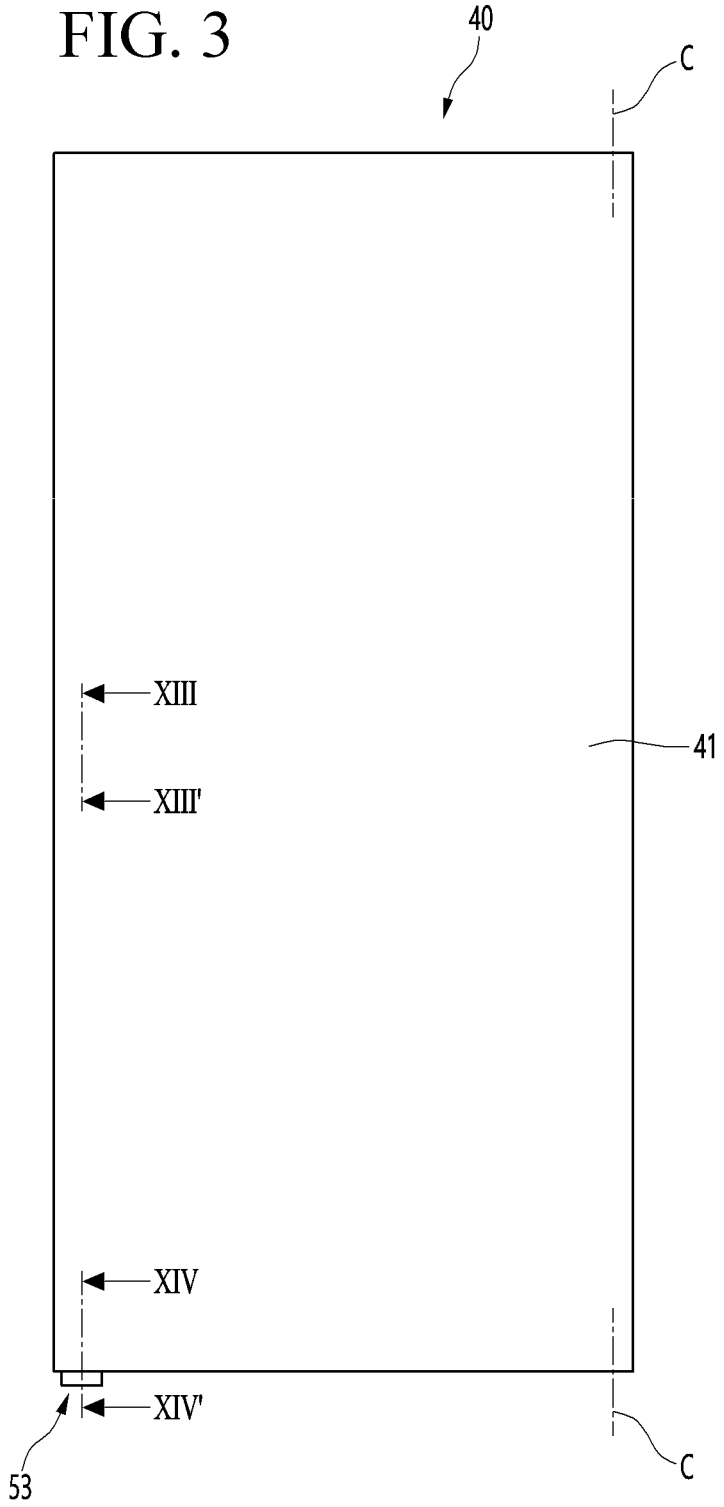
FIG. 3 is a front view of the sub-door.
Figure 4:
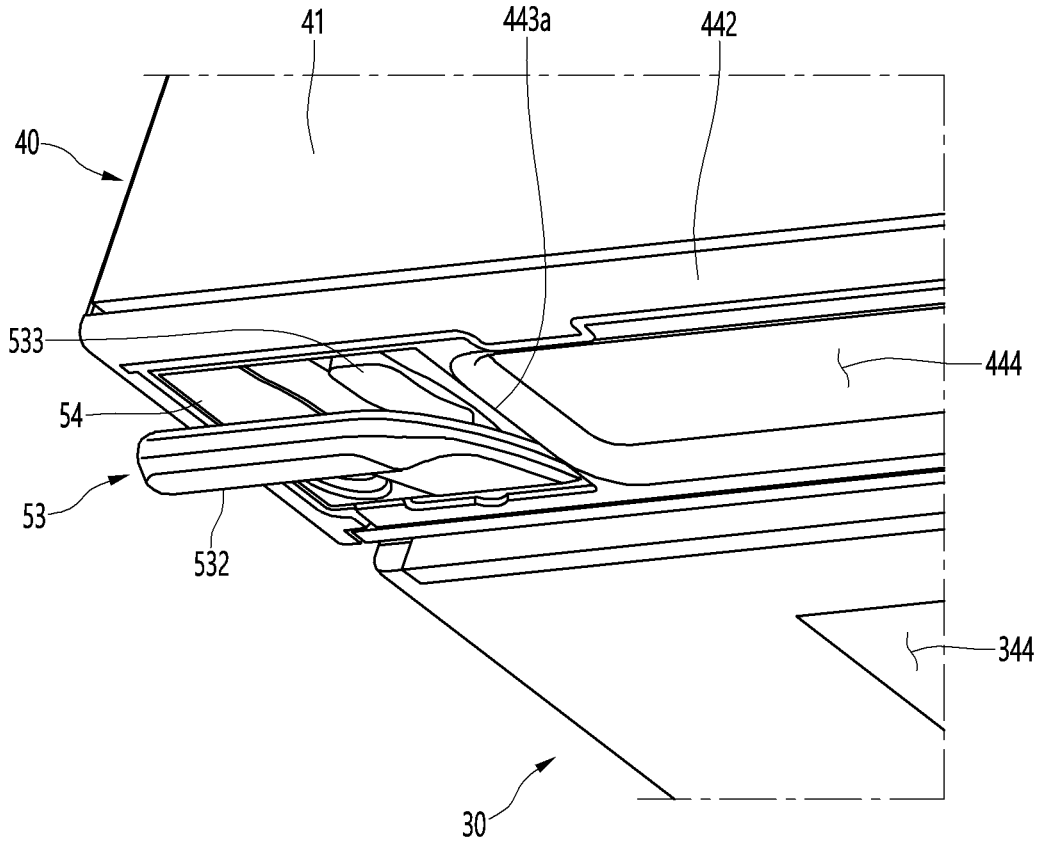
FIG. 4 is a partial perspective view of the sub-door when viewed from the bottom in a state in which the sub-door is closed.
Figure 5:
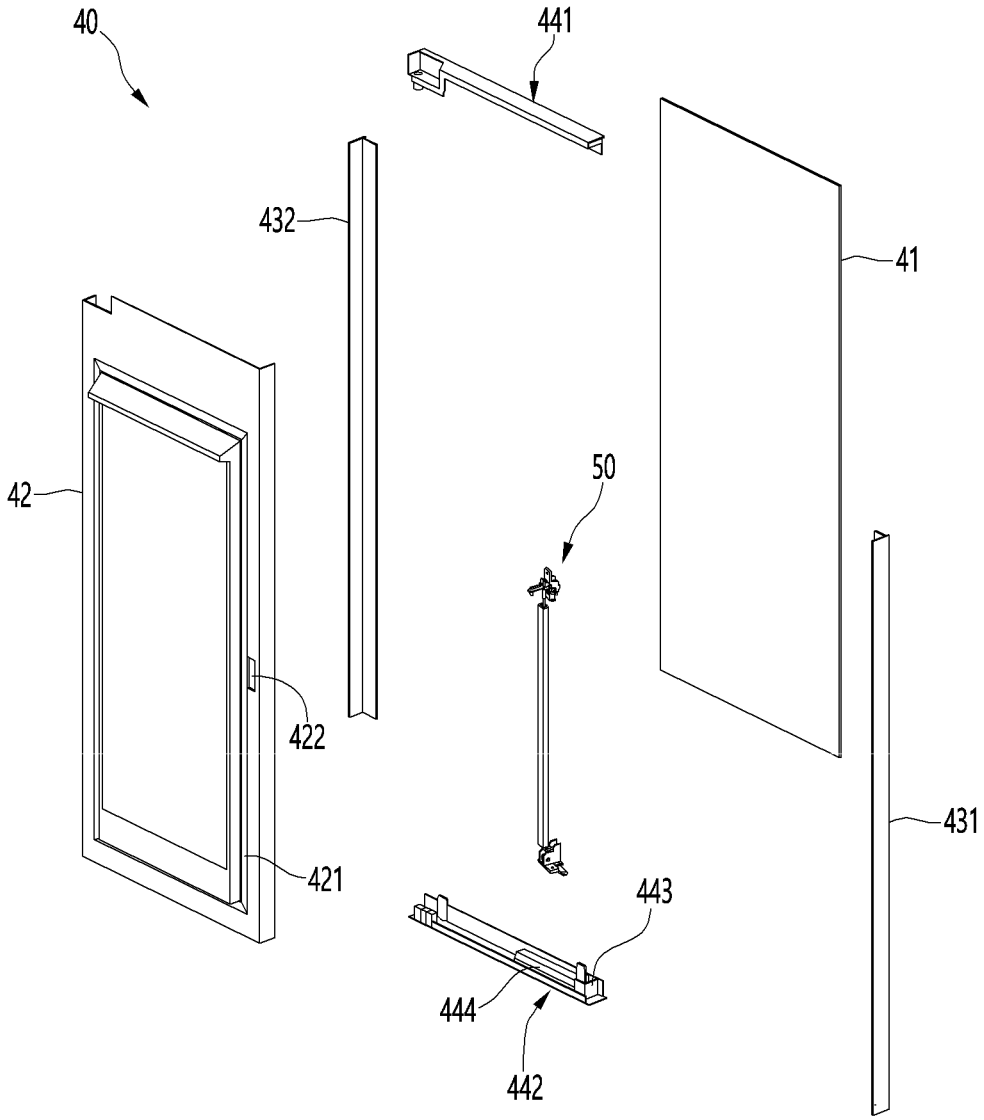
FIG. 5 is an exploded perspective view of the sub-door.

FIG. 3 is a front view of the sub-door. FIG. 4 is a partial perspective view of the sub-door when viewed from the bottom in a state in which the sub-door is closed. FIG. 5 is an exploded perspective view of the sub-door.

As shown in the figure, the sub-door 40 may be formed in a shape corresponding to that of the main door 30 and may include a panel assembly 41 defining a front surface and a door liner 42 defining a rear surface. In addition, the sub-door 40 may include a pair of cap decorations 441 and 442 defining an upper surface and a lower surface. In addition, the sub-door 40 may include side frames 431 and 432 defining left and right sides. In addition, the sub-door 40 may be filled with a heat insulating material 45. Meanwhile, the side frames 431 and 432 may be omitted according to the shape and structure of the sub-door 40, and both sides of the sub-door 40 may be defined by the panel assembly 41.

The panel assembly 41 may define the front surface of the sub-door 40, and may be formed of a plate-shape metal, glass, ceramic material. In addition, the door liner 42 may define the rear surface of the sub-door 40, and is in contact with the front surface of the main door 30 in a state in which the sub-door 40 is closed.

The door liner 42 may provide a coupling structure of the panel assembly 41 and the cap decorations 441 and 442. In addition, the door liner 42 may be provided with a gasket 421, and the circumference of the opening 31 may be hermetically sealed by the gasket 421 in a state in which the sub-door 40 is closed.

The cap decorations 441 and 442 may connect the upper and lower ends of the panel assembly 41 and the door liner 42. In addition, the side frames 431 and 432 may connect both ends of the panel assembly 41 and the door liner 42.

A space between the panel assembly 41 and the door liner 42 may be filled with heat insulating material 45, and the sub-door 40 may have satisfactory heat insulating performance.

Meanwhile, the opening/closing assembly 50 for locking and opening the sub-door 40 may be provided inside the sub-door 40.

The opening/closing assembly 50 may vertically extend inside the sub-door 40, and may be disposed between a locking member accommodation part 422 formed in the door liner 42 and an operation member accommodation part 443 formed in the cap decoration 442.

The opening/closing assembly 50 is disposed along one end far from the rotation axis C of the sub-door 40 between the left and right ends of the sub-door 40, and may extend from the lower end to the middle height of the sub-door 40.

In addition, an operation member 53 configuring the opening/closing assembly 50 in a state in which the opening/closing assembly 50 is installed on the sub-door 40 may be exposed through the lower end of the sub-door 40, that is, the cap decoration 442, and the locking member 51 may be exposed through the rear surface of the sub-door 40, that is, the door liner 42.

In this case, the operation member 53 may be disposed on the lower edge of the sub-door 40, and may be disposed on the lower edge in which the pair of upper doors 21 disposed side by side is adjacent to each other. In addition, the operation member 53 may be exposed through a space between the upper door 21 and the lower door 22 disposed vertically, that is, a space formed such that the user puts their hand to hold the lower end of the upper door 21 or the upper end of the lower door 22. Accordingly, the operation member 53 may be disposed to minimize external exposure and to facilitate operation for opening of the sub-door 40.

In particular, the operation member 53 may be located at the lower end of the sub-door 40 far from the rotation axis C of the sub-door 40. Accordingly, when operating the operation member 53, rotation operation of the sub-door 40 may be facilitated.

To this end, an operation member accommodation part 443 in which the operation member 53 is mounted may be formed on one end far from the rotation axis C of the sub-door 40 of the lower surface of the cap decoration 442. In this case, the operation member 53 may be mounted such that only an operation part 532 pressed by the user is exposed through the opening of the operation member accommodation part 443. Accordingly, it is possible to minimize exposure of the operation part 532 to the outside while operation of the operation member 53 is possible.

In addition, a handle groove 444 may be further formed in the lower surface of the cap decoration 442. The handle groove 444 may be disposed side by side with the operation member accommodation part 443, and may be in contact with the operation member accommodation part 443. Accordingly, the user may simultaneously perform operation of the operation member 53 and operation of pulling the handle groove 444 at the same position without changing the position of the hand.

In addition, the handle groove 444 of the sub-door 40 may be disposed in the front-and-rear direction of the handle groove 344 of the main door 30, and may be formed at a corresponding position such that opening/closing operation of the sub-door 40 and the main door 30 is performed at the same position, thereby further facilitating opening/closing operation of all the doors of the refrigerator 1. That is, although not shown in detail, to open the lower door 22, the handle roove formed in the upper end of the lower door may also be located to face the handle groove 344 of the main door 30 or the handle groove 444 of the sub-door 40.

Hereinafter, the structure of the opening/closing assembly 50 will be described in greater detail with reference to the drawings.

Figure 6:
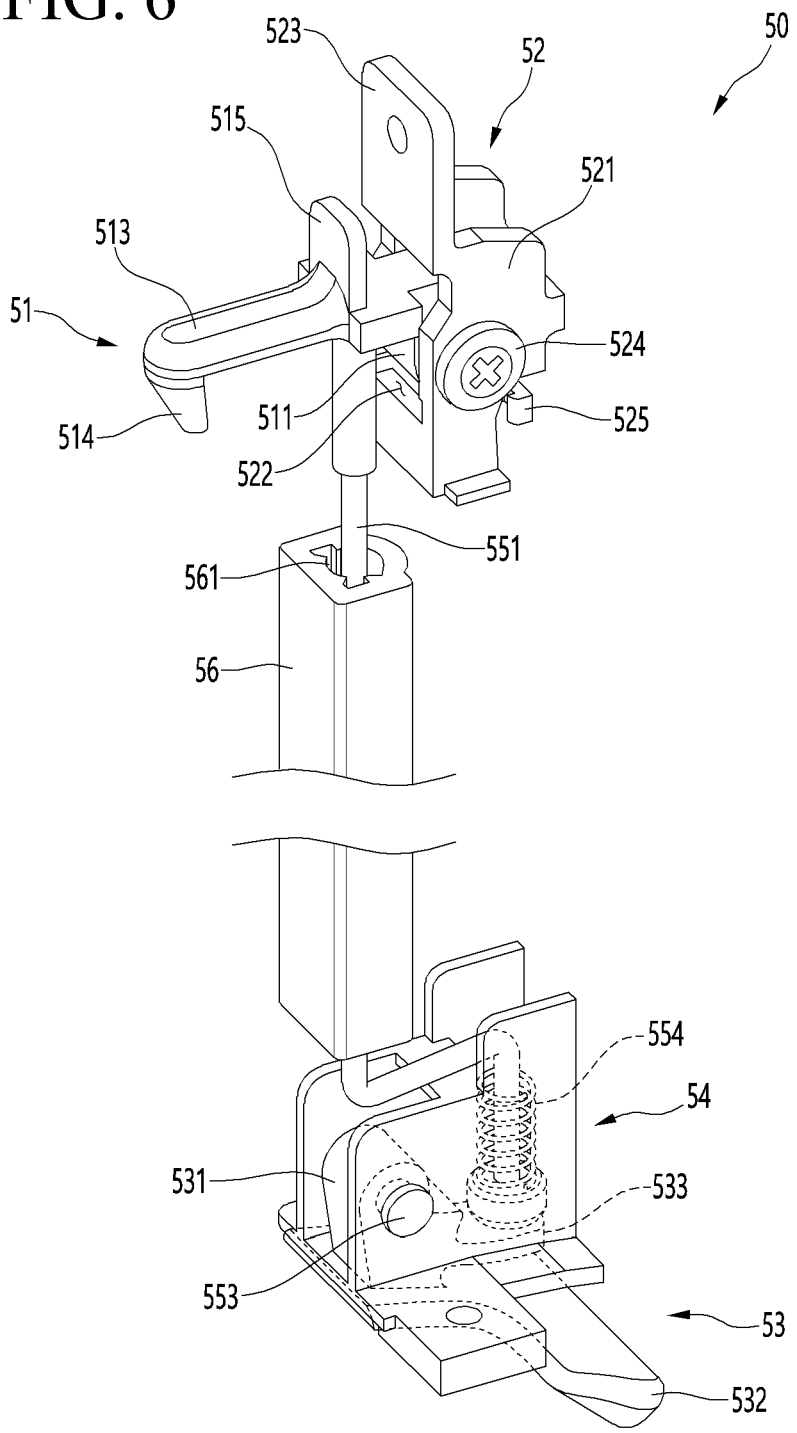
FIG. 6 is a perspective view of an opening/closing assembly according to an embodiment of the present disclosure.
Figure 7:
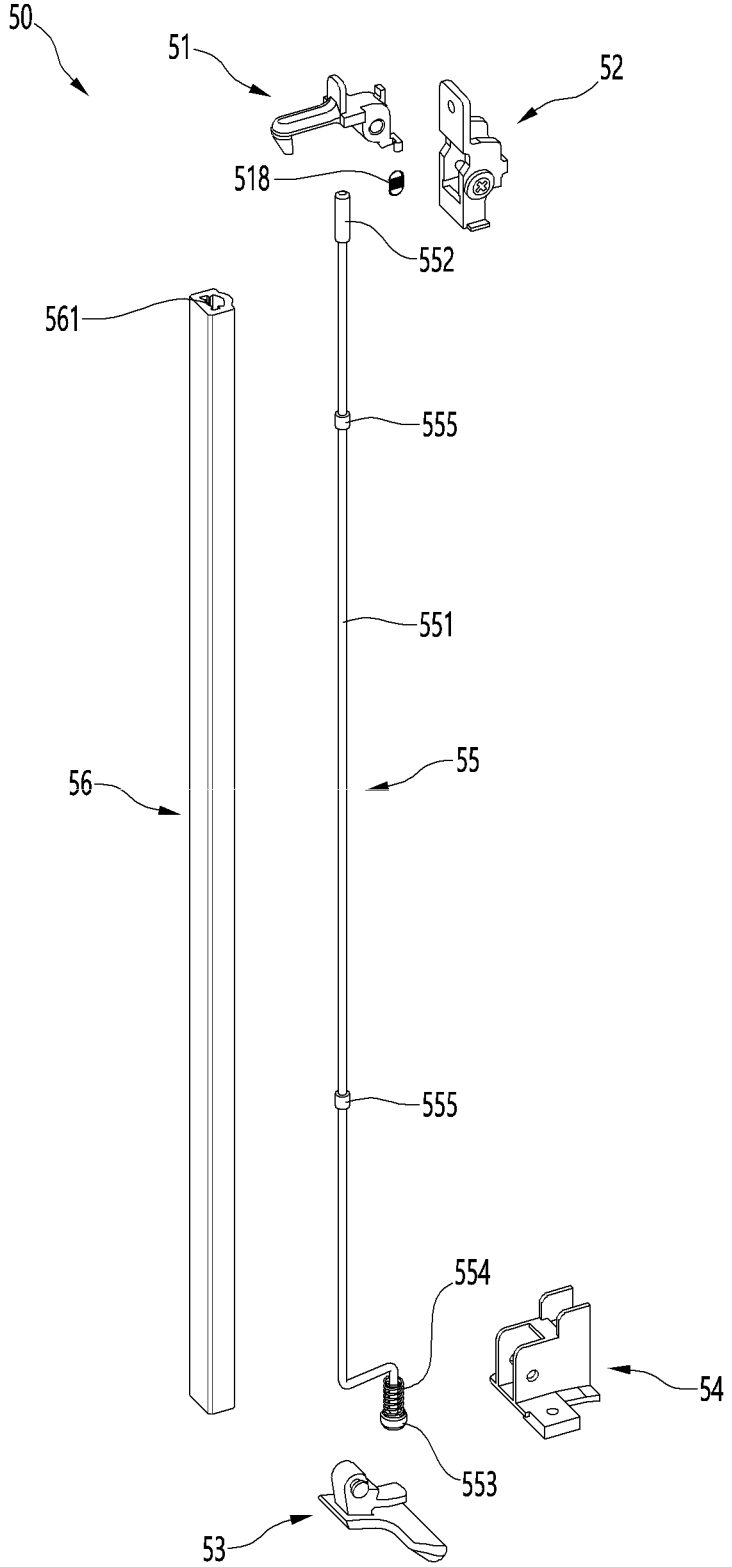
FIG. 7 is an exploded perspective view of the opening/closing assembly.
Figure 8:
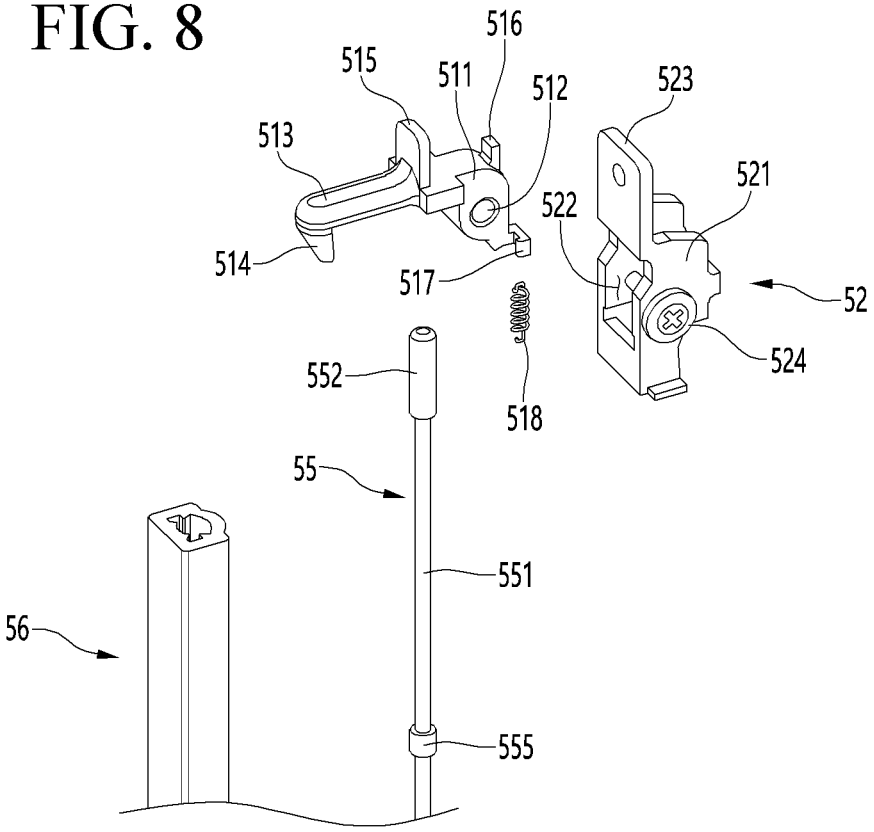
FIG. 8 is an enlarged view of the top of FIG. 7.
Figure 9:
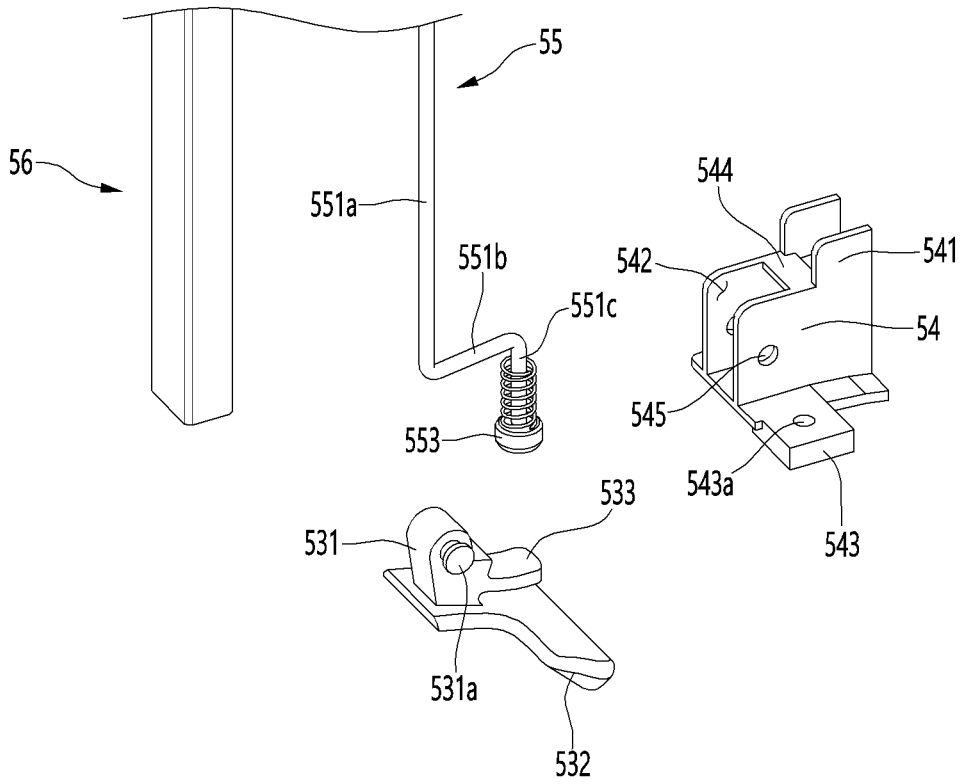
FIG. 9 is an enlarged view of the bottom of FIG. 7.
Figure 10:
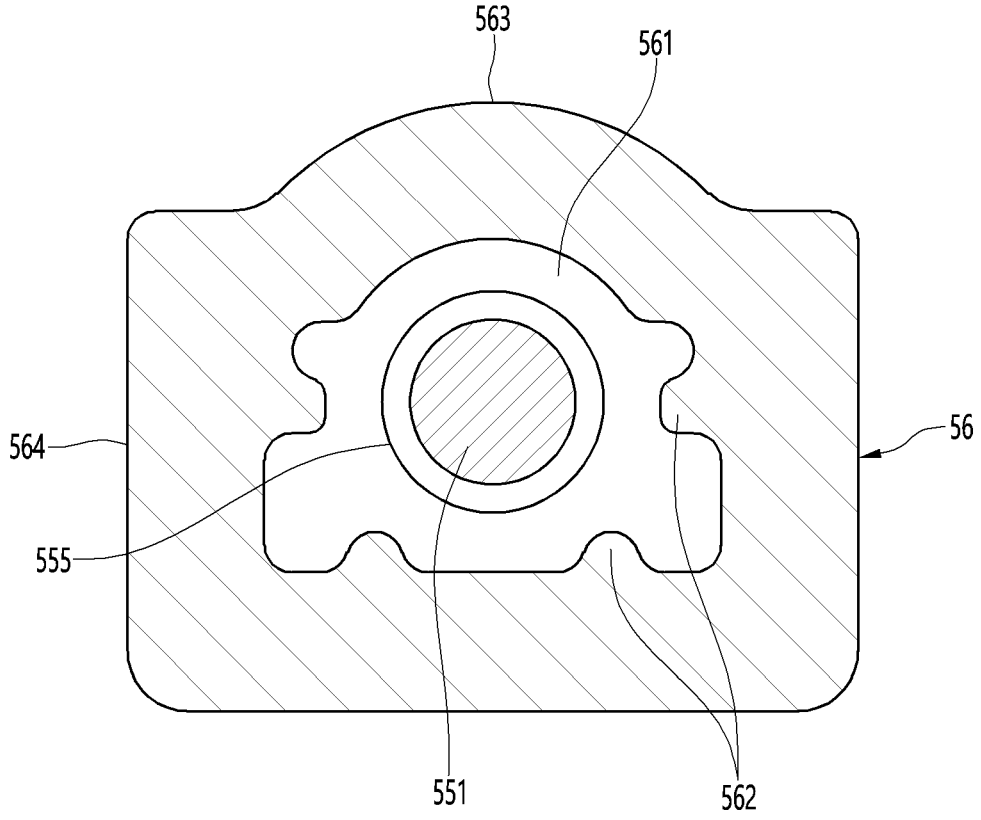
FIG. 10 is a cross-sectional view of a connection member case in a state in which the connection member of the opening/closing assembly is mounted.

FIG. 6 is a perspective view of an opening/closing assembly according to an embodiment of the present disclosure. FIG. 7 is an exploded perspective view of the opening/closing assembly. FIG. 8 is an enlarged view of the top of FIG. 7. FIG. 9 is an enlarged view of the bottom of FIG. 7. FIG. 10 is a cross-sectional view of a connection member case in a state in which the connection member of the opening/closing assembly is mounted.

As shown in the figure, the opening/closing assembly 50 may include a locking member 51 locked to the locking part 331 of the main door 30, an operation member 53 exposed through the cap decoration 442 and operated by the user, a connection member 55 connecting the locking member 51 and the operation member 53, and a connection member case 56 in which the connection member 55 is accommodated.

The locking member 51 may include a locking member body 511 accommodated in the locking member accommodation part 422. In addition, a body hole 512, through which a locking member rotation shaft 524 penetrates, may be formed in the locking member body 511. In addition, a body extension 513 extending forward from the locking member body 511 may be formed, and the body extension 513 may extend to be extended to the outside through the accommodation part cover 424. In addition, a locking hook 514 protruding downward may be formed on an end of the body extension 513. The locking hook 514 may be engaged with the locking protrusion 332 of the locker such that the sub-door 40 is maintained in the closed state.

In addition, a front stopper 515 protruding upward may be formed on the body extension 513. The front stopper 515 limits a rotation angle such that the locking member 51 does not excessively rotates forward (clockwise in FIG. 6) when the locking member 51 rotates to open the sub-door 40. The front stopper 515 may be disposed in front of the body hole 512, and may be in contact with the front surface of the locking member bracket 52 described below when the locking member 51 rotates.

In addition, a rear stopper 516 may be further formed on the locking member body 511. The rear stopper 516 is located behind the body hole 512 and may extend upward. The rear stopper 516 may enable the locking member 51 to stop at an accurate position when the locking member 51 rotates backward (counterclockwise in FIG. 6), and the locking member 51 may be maintained in a state of being locked to the locker 331. In this case, the rear stopper 516 is in contact with a stopper protrusion 527 protruding downward from the locking member bracket 52 such that the locking member 51 no longer rotates backward (counterclockwise in FIG. 6).

In addition, a lower end of the locking member body 511 may be formed with a locking member-side connector 517 connected with a lower end of an upper spring 518. The upper spring 518 may extend when the locking member 51 rotates forward and provide elastic force such that the locking member 51 returns to an original position.

Meanwhile, the opening/closing assembly 50 may include a locking member bracket 52 in which the locking member 51 is mounted.

The locking member bracket 52 may be formed such that the locking member 51 is rotatably mounted. In addition, the locking member bracket 52 may be fixed to the inside of the locking member accommodation part 422. Accordingly, by the locking member bracket 52, the locking member 51 may be rotatably disposed inside the locking member accommodation part 422.

Specifically, the locking member bracket 52 may include a bracket body 521 defining a space 522 into which the locking member 51 is inserted. A locking member rotation shaft 524 penetrating through the body hole 512 may be inserted into the bracket body 521. That is, in a state in which the locking member 51 is inserted into the locking member bracket 52, the locking member rotation shaft 524 may penetrate through the locking member bracket 52 and the locking member 51 and thus the locking member 51 may be rotatably mounted.

The bracket body 521 may be formed with a bracket mounting part 523 extending upward, and a screw hole to which a screw is fastened may be formed in the bracket mounting part 523. The screw may be fastened to the locking member accommodation part 422 by penetrating through the bracket mounting part 523, such that the locking member bracket 52 is fixedly mounted in the locking member accommodation part 422 by the screw.

In addition, the bracket body 521 may be formed with a bracket-side connector 525 coupled with an upper end of the upper spring 518. The upper end of the upper spring may be fixed to the bracket-side connector 525 and the lower end thereof may be fixed to the locking member-side connector 517. Accordingly, when the locking member 51 rotates forward, the upper spring 518 is stretched and, when external force is removed, the locking member 51 may rotate backward by the elastic force of the upper spring 518.

The operation member 53 may be provided at the lower end of the opening/closing assembly 50, and at least a portion thereof may be accommodated in the operation member accommodation part 443 formed in the cap decoration 442.

The operation member 53 may include a rotatably mounted operation member body 531, the operation part 532 pressed by the user, and a support 533 supporting the lower end of the connection member 55.

Specifically, the operation member body 531 may be rotatably mounted in an operation member bracket 54 described below. To this end, an operation member rotation shaft 531*a* protruding to the left and right sides may be formed at the upper end of the operation member body 531.

In addition, the operation part 532 may be formed at the lower end of the operation member body 531. The operation part 532 may extend forward from the operation member body 531, and extend in a direction away from the rotation member rotation shaft 531*a*. In addition, the lower surface of the operation member 53 is formed to extend downward toward the front side such that the user presses the operation part 532 to easily rotate the operation member 53.

In addition, the support 533 extending forward may be formed at the operation member body 531. The support 533 is located above the operation part 532, and may extend in a direction away from the operation member rotation shaft 531*a*. The support 533 may extend past the lower end of the connection member 55, and push the connection member 55 up when the operation member 53 rotates forward (counterclockwise in FIG. 6). To this end, the support 533 may extend forward from the lower side of the operation member rotation shaft 531*a*.

Meanwhile, the opening/closing assembly 50 may include the operation member bracket 54 in which the operation member 53 is mounted.

The operation member bracket 54 may be formed such that the operation member 53 is rotatably mounted. In addition, the operation member bracket 54 may be fixed to the inside of the operation member accommodation part 443. Accordingly, by the operation member bracket 54, the operation member 53 may be rotatably disposed inside the operation member accommodation part 443.

Specifically, the operation member bracket 54 may include an operation member body 531 defining a space 542 in which the operation member 53 is rotatably mounted. The operation member body 531 may be opened downward, and the operation member 53 may be inserted and mounted upward from the lower side. In addition, a shaft coupling hole 545, through which the operation member rotation shaft 531*a* penetrates, may be formed in the operation member body 531. Accordingly, the operation member 53 may be rotatably mounted in the operation member bracket 54.

A connection member support 533 may be formed at the upper surface of the operation member body 531. The connection member support 533 may support the connection member 55 such that the connection member does not fall. Specifically, the below-described horizontal bending part 551*b* of the connection member 55 may be supported on the upper surface of the connection member support 533, and a lower vertical part 551*c* may penetrate. In addition, an upper surface of a lower spring 554 described below may be supported on the lower surface of the connection member support 533.

In addition, a body mounting part 543 extending laterally may be further formed at the lower surface of the operation member body 531. A screw hole 543*a* to which the screw may be fastened may be formed in the body mounting part 543, and the screw may penetrate through the body mounting part 543 to be fastened to the operation member accommodation part 443. Accordingly, the operation member bracket 54 may be fixedly mounted inside the operation member accommodation part 443.

In a state in which the operation member 53 is mounted in the operation member bracket 54, the portion except for the operation part 532 is accommodated in the operation member bracket 54 and only the operation part 532 is exposed to the outside and may be operated by the user.

The connection member 55 may extend to connect the locking member 51 and the operation member 53. Accordingly, when operating the operation member 53, the locking member 51 may be interlocked by the connection member 55.

The connection member 55 may include a rod 551 extending vertically. The rod 551 may be made of a steel material to prevent deformation and damage and may be formed to have a circular cross-section. In addition, the lower end of the connection member 55 may be in contact with the upper surface of the support 533 of the operation member 53 and the upper end thereof may be in contact with the lower surface of the body extension 513 of the locking member 51.

The rod 551 may be formed to be bent multiple times for smooth operation transfer of the locking member 51 and the operation member 53. Specifically, the rod 551 may include an upper vertical part 551*a* extending vertically, a horizontal bending part 551*b* bent from the lower end of the upper vertical part 551*a* and a lower vertical part 551*c* bent downward from the extended end of the horizontal bending part 551*b*.

The upper vertical part 551*a* may vertically extend downward from the lower surface of the body extension 513, and extend to the operation member bracket 54. In this case, the upper vertical part 551*a* may extend in parallel with the side surface of the sub-door 40.

The horizontal bending part 551*b* may be vertically bent forward from the lower end of the upper vertical part 551*a*. The horizontal bending part 551*b* may extend past the bracket support 533, and, when the connection member 55 moves downward as much as possible, downward movement of the horizontal being part 551*b* may be limited by the bracket support 533.

The lower vertical part 551*c* may be vertically bent downward from the front end of the horizontal bending part 551*b*, and may penetrate through the bracket support 533 to extend downward. The horizontal bending part 551*b* may be supported by the connection member support 533 so as not to move any longer.

Meanwhile, the upper end of the connection member 55 may be provided with an upper cap 552. The upper cap 552 may be in contact with the body extension 513, and may be formed such that the upper end of the upper vertical part 551 is inserted. The upper cap 552 may have a larger diameter than the cross section of the rod 551, and the upper end of the upper cap 552 may be formed in a planar shape. Accordingly, the upper end of the connection member 55, that is, the upper surface of the upper cap 552, may be in more stable contact with the body extension 513.

In addition, the upper cap 552 may be formed of a soft material such as rubber or silicon. Accordingly, it is possible to prevent noise generated while the rod 551 is in direct contact with the locking member 51 and to prevent impact. Therefore, it is possible to further improve feeling of operation when operating the operation member 53.

In addition, the lower end of the connection member 55 may be provided with a lower cap 553. The lower end of the lower vertical part 551*c* may be inserted into the lower cap 553. In addition, the lower cap 553 may also be formed of a soft material such as rubber or silicon, similarly to the upper cap 552. Accordingly, the lower cap 553 may be in contact with the operation member 53 to prevent noise and impact upon contact and to improve feeling of operation of the operation member 53.

In particular, the lower surface of the lower cap 553 may have a central part protruding downward and a circumference having a rounded shape. Accordingly, when rotating the operation member 53, the lower surface of the lower cap 553 and the operation member support 533 may be efficiently brought into contact with each other.

In addition, a lower spring 554 may be mounted on the lower vertical part 551*c*. The lower vertical part 551*c* may penetrate through the lower spring 554, and the upper end of the lower spring 554 may be in contact with the lower surface of the connection member support 533, and the lower end of the lower spring 554 may be in contact with the lower cap 553. Accordingly, it may be compressed when the connection member 55 moves upward. In addition, when external force applied to the connection member 55 is removed, the connection member 55 may move downward and return to an original position by elastic force of the lower spring 554.

Meanwhile, the connection member 55 may further include a rod guide 555. The rod guide 555 may be vertically disposed on the rod 551 at regular intervals, and may be formed with a larger size than the diameter of the rod 551. The rod guide 555 may be mounted such that the rod 551 penetrates therethrough and may be formed to protrude from the rod 551 to the outside.

A plurality of rod guides 555 may be formed on the upper vertical part 551*a* of the rod 551. In addition, the plurality of rod guides 555 may be formed on a portion accommodated in the connection member case 56 of the connection member 55. The rod guide 555 may be formed with a size capable of being accommodated in the cross section of the internal space of the connection member case 56. That is, the outer diameter of the rod guide 555 may be less than the inner diameter of the connection member case 56 or the horizontal or vertical length of the connection member case 56. Accordingly, vertical movement of the connection member 55 is ensured inside the connection member case 56, and, upon vertical movement of the connection member 55, the rod guide 555 may be partially brought into contact with the inner surface of the connection member case 56. Therefore, even when the connection member 55 operates, the position of the connection member 55 may be maintained.

The connection member case 56 may be formed in a pipe or tube shape having an accommodation space 561 formed therein. The connection member case 56 may vertically extend, and may be formed to connect the locking member accommodation part 422 and the operation member accommodation part 443. In addition, the connection member case 56 vertically extends and may have a shorter vertical length than the connection member 55. Accordingly, in a state in which the connection member 55 is inserted into the connection member case 56, the upper and lower ends of the connection member 55 may protrude from the upper and lower ends of the connection member case 56. In particular, the upper vertical part 551*a* of the connection member 55 may be accommodated in the connection member case 56, and the horizontal bending part 551*b* and the lower vertical part 551*c* may be located outside the connection member case 56.

In addition, the connection member case 56 may have an opened upper and lower surfaces, and an accommodation space 561, into which the upper vertical part 551*a* is inserted, may be formed in the connection member case 56. The cross section of the accommodation space 561 may be formed to be larger than the outer diameters of the rod 551 and the rod guide 555. Accordingly, even in a state in which the connection member 55 is mounted to pass through the connection member case 56, vertical movement may be smooth.

Meanwhile, reinforcement parts 562 and 563 may be formed at the connection member case 56. The reinforcement parts 562 and 563 are to prevent deformation and damage of the connection member case 56 extending vertically and may vertically extend in the extension direction of the connection member case 56.

Specifically, the connection member case 56 may be formed of a plastic or metal material, and may be formed by extrusion as a single component. Accordingly, the connection member case 56 may be formed to have the same cross-sectional shape.

The connection member case 56 is provided inside the sub-door 40, and may be embedded in the heat insulating material 45, with which the sub-door 40 is filled. In addition, the reinforcement parts 562 and 563 capable of preventing the connection member case 56 from being deformed by pressure generated in a process in which the heat insulating material 45 flows into the sub-door 40 may be formed at the connection member case 56. The reinforcement parts 562 and 563 may include an inner reinforcement part 562 provided inside the connection member case 56 and an outer reinforcement part 563 provided outside the connection member case 56. In addition, the reinforcement parts 562 and 563 may include only any one of the inner reinforcement part 562 and the outer reinforcement part 563.

The structure of the connection member case 56 will be described with reference to FIG. 10. An accommodation space 561 in which the connection member 55 is accommodated may be formed in the connection member case 56, and the accommodation space 561 may be vertically opened.

The inside of the accommodation space 561 may be formed larger than the outer diameter of the connection member 55 to guide stable vertical movement of the connection member 55. That is, the inside of the accommodation space 561 may be formed with a size capable of being spaced apart from the rod guide 555.

The inner reinforcement part 562 may be formed inside the accommodation space 561. The inner reinforcement part 562 may protrude from the inner surface of the accommodation space 561 toward the connection member 55. In addition, the inner reinforcement part 562 may extend in a vertical direction to prevent deformation of the connection member case 56.

In addition, a plurality of inner reinforcement parts 562 may be formed at regular intervals, and may be formed at positions facing each other with respect to the connection member 55. By the plurality of inner reinforcement parts 562, a plurality of grooves may be formed in the inner surface of the accommodation space 561. Accordingly, the connection member 55 may not be brought into the entire inner surface of the accommodation space 561 even if moving in the operation process but may be brought into the inner reinforcement part 562, thereby ensuring stable operation of the connection member 55.

Meanwhile, the outer reinforcement part 563 may be formed on the outer surface 564 of the connection member case 56. The connection member case 56 may be formed to have a polygonal cross-sectional shape. For example, the connection member case 56 may be formed in a rectangular cross-sectional shape and the outer reinforcement part 563 may protrude from one surface thereof.

In this case, the outer reinforcement part 563 may be formed on a surface facing the panel assembly 41 of the outer surface 564 of the connection member case 56. In addition, the outer surface 564 facing the outer reinforcement part 563 may be formed in a planar shape, and may be in close contact with the door liner 42.

The outer reinforcement part 563 may be formed in a curved shape with a protruding center. Accordingly, when the heat insulating material 45 is injected into the sub-door 40, the heat insulating material 45 in contact with the outer reinforcement part 563 may be distributed to both sides, thereby preventing excessive pressure from being applied to the connection member case 56.

Hereinafter, the fixing structure of the connection member case 56 will be described with reference to the drawings.

Figure 11:
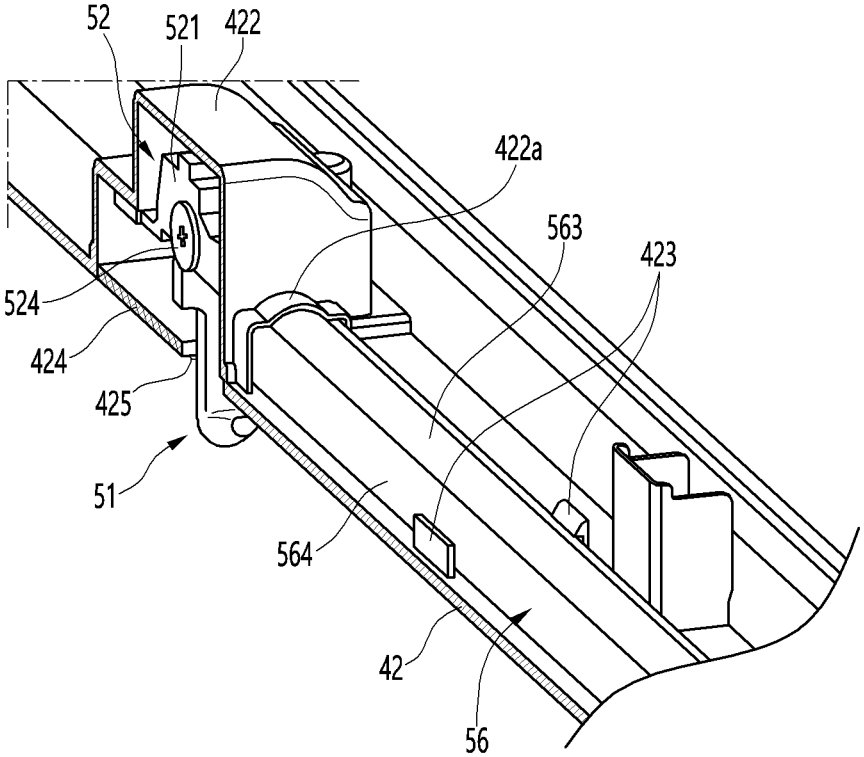
FIG. 11 is a partially cut perspective view illustrating the mounting state of an upper portion of the opening/closing assembly.
Figure 12:
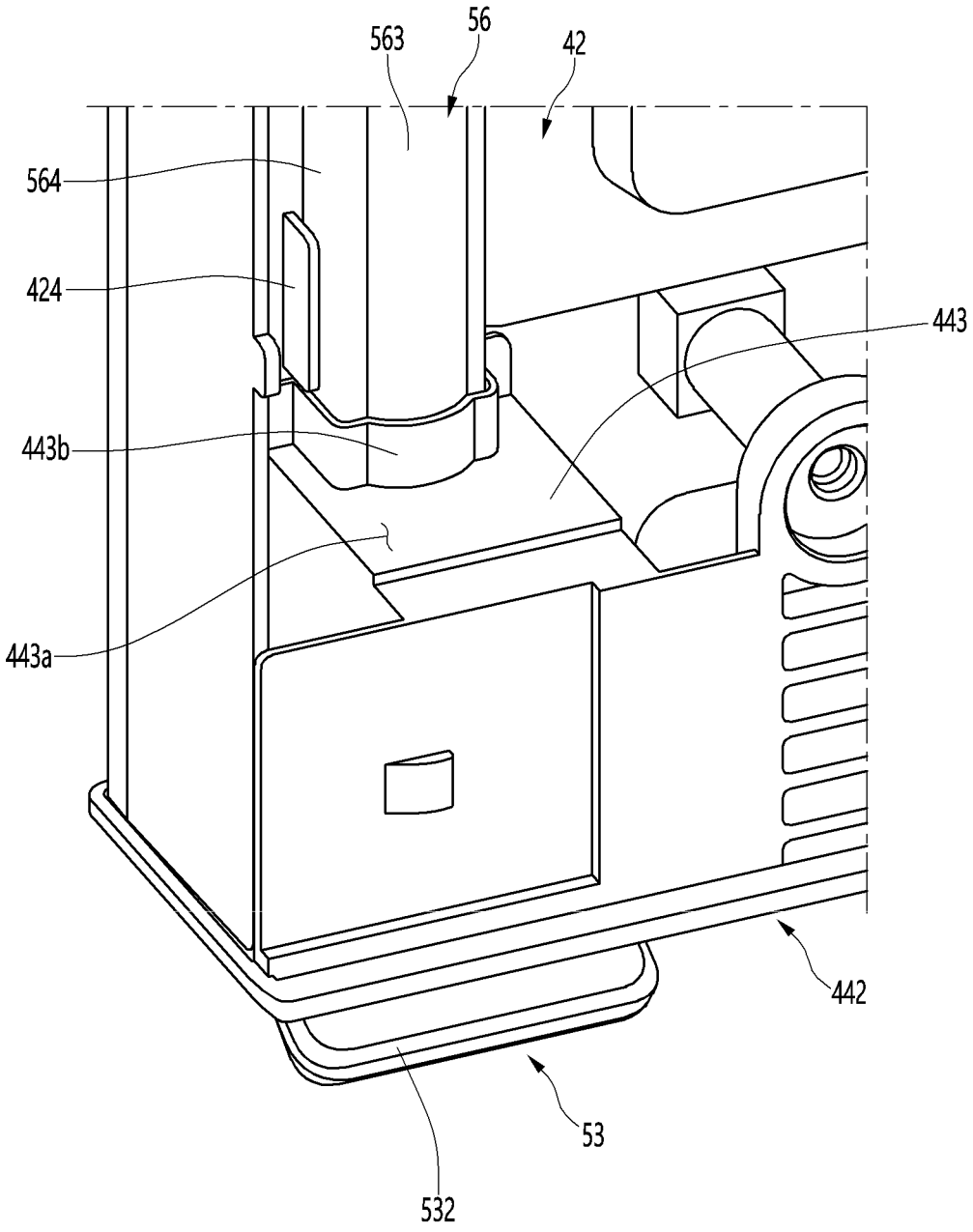
FIG. 12 is a partial perspective view illustrating the mounting state of a lower portion of the opening/closing assembly.

FIG. 11 is a partially cut perspective view illustrating the mounting state of an upper portion of the opening/closing assembly. FIG. 12 is a partial perspective view illustrating the mounting state of a lower portion of the opening/closing assembly.

As shown in the figure, a locking member accommodation part 422 recessed such that the locking member 51 is accommodated therein may be formed in the door liner 42. In addition, the locking member bracket 52 coupled with the locking member 51 may be fixedly mounted inside the locking member accommodation part 422. In addition, the opened rear surface of the locking member accommodation part 422 may be shielded by the accommodation part cover 424, and the body extension 513 of the locking member 51 may protrude backward through the cover hole 425 of the accommodation part cover 424.

Meanwhile, the upper end of the connection member 55 may pass through the lower surface of the locking member accommodation part 422, and the upper end of the connection member 55 may be in contact with the lower surface of the body extension 513 inside the locking member accommodation part 422 to rotate the locking member 51.

In addition, an upper mounting part 422*a* in which the connection member case 56 is mounted may be formed in the lower surface of the locking member accommodation part 422. The upper mounting part 422*a* may be formed such that the upper end of the connection member case 56 is inserted, and may be formed to surround the upper end of the connection member case 56 in a state in which the connection member case 56 is mounted. Accordingly, the connection member case 56 may maintain a state of being firmly coupled with the locking member accommodation part 422, and, in particular, prevent the heat insulating material 45 from permeating into the locking member accommodation part 422 and the connection member case 56.

The operation member accommodation part 443 in which the operation member 53 is mounted may be formed in the cap decoration 442. The operation member accommodation part 443 may be opened downward, and may be formed in one end of the cap decoration 442 far from the rotation axis C of the sub-door 40.

The operation member 53 may be mounted inside the operation member accommodation part 443 in a state of being coupled with the operation member bracket 54. In addition, the operation member 53 may be disposed such that the operation part 532 is exposed through the accommodation part opening 443*a*.

The lower end of the connection member 55 may be inserted through the upper surface of the operation member accommodation part 443, and may be in contact with the support 533 of the operation member 53 inside the operation member accommodation part 443. Accordingly, the connection member 55 may vertically move according to rotation operation of the operation member 53.

In addition, a lower mounting part 443*b* in which the connection member case 56 may be formed in the upper surface of the operation member accommodation part 443. The lower mounting part 443*b* may be formed such that the lower end of the connection member case 56 is inserted, and may be formed to surround the lower end of the connection member case 56 in a state in which the connection member case 56 is mounted. Accordingly, the connection member case 56 may maintain a state of being firmly coupled with the operation member accommodation part 443, and, in particular, prevent the heat insulating material 45 from permeating into the operation member accommodation part 443 and the connection member case 56.

As such, the connection member case 56 may be formed to connect the locking member accommodation part 422 and the operation member accommodation part 443. In addition, the connection member case 56 may be fixedly mounted on the rear surface of the door liner 42.

Specifically, at least one surface of the outer surfaces of the connection member case 56 may be formed in a planar shape, and may be in close contact with the rear surface of the door liner 42. In this case, one surface of the connection member case 56 in contact with the door liner 42 may face the outer reinforcement part 563.

In addition, a plurality of case fixing parts 423 may be formed at the door liner 42 along both sides of the connection member case 56. The case fixing parts 423 may extend in a direction crossing the extension direction of the connection member case 56, and lock both sides of the connection member 55. In addition, some of the case fixing parts 423 may have a structure in which an end is formed in a hook shape and is engaged with the outer surface of the connection member case 56. In addition, the plurality of case fixing parts 423 may be continuously disposed along both sides of the connection member case 56.

In this way, the connection member case 56 may be firmly fixed by the upper mounting part 422*a*, the lower mounting part 443*b* and the case fixing parts 423 in a state of being in close contact with the door liner 42. Accordingly, the connection member case 56 does not deviate from the mounting position by pressure of the heat insulating material 45 injected into the sub-door 40, and maintain the mounting state at an accurate position even repeated impact by opening/closing of the sub-door 40.

Hereinafter, operation of the opening/closing assembly 50 having the above-described structure will be described.

Figure 13:
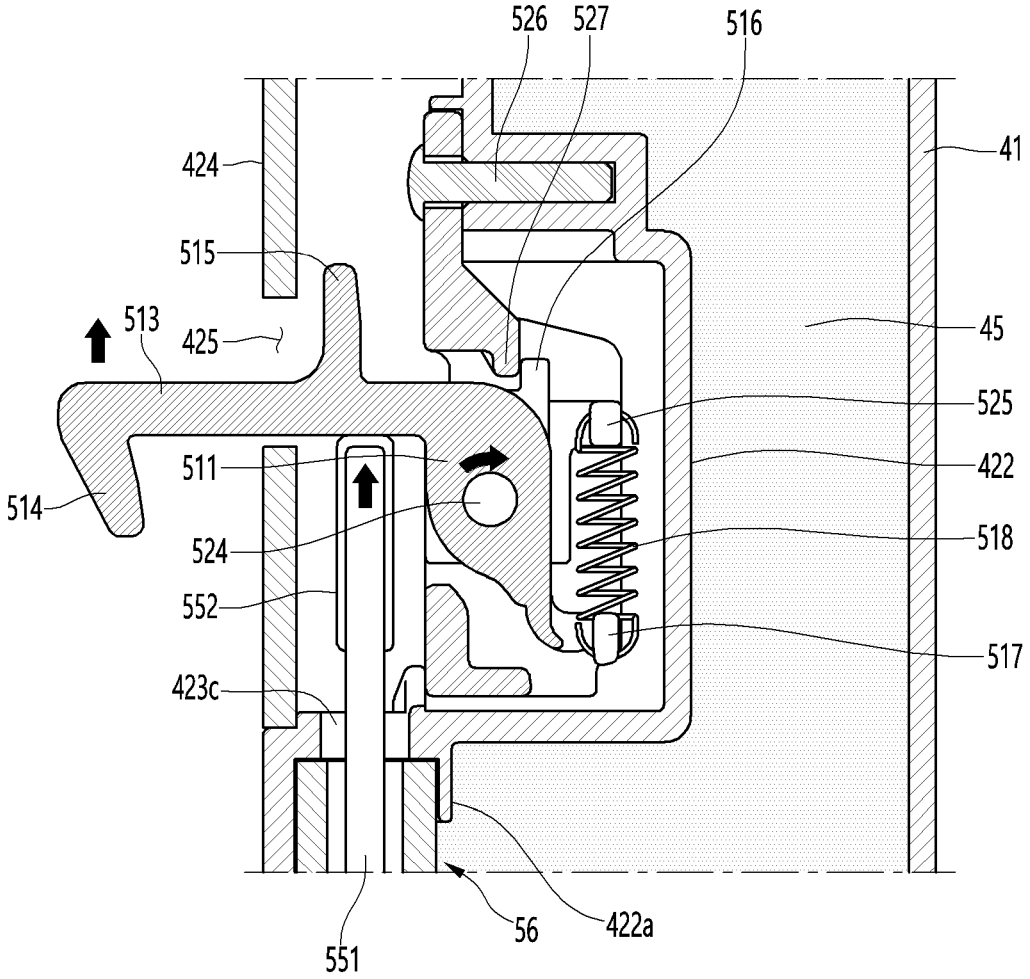
FIG. 13 is a cross-sectional view taken along line XIII-XIII' of FIG. 3.
Figure 14:
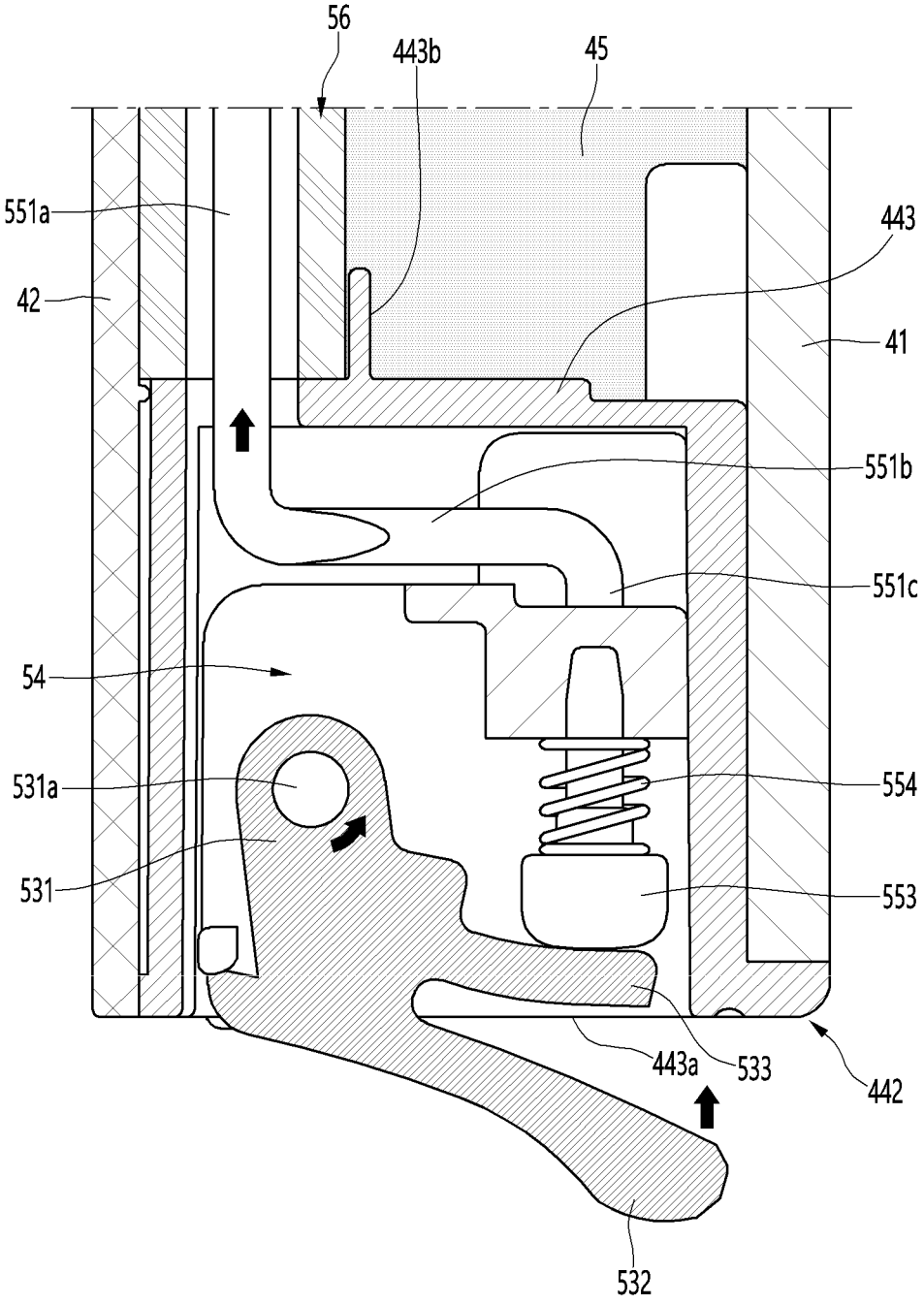
FIG. 14 is a cross-sectional view taken along line XIV-XIV' of FIG. 3.

FIG. 13 is a cross-sectional view taken along line XIII-XIII' of FIG. 3. FIG. 14 is a cross-sectional view taken along line XIV-XIV' of FIG. 3.

As shown in the figure, in a state in which the sub-door 40 is closed, the locking member 51 may be in a state shown in FIG. 13. In this case, the locking member 51 may be inserted into the locker 331, and the locking hook may be locked to the locking protrusion such that the sub-door 40 is always maintained in a closed state.

In addition, in a state in which the user does not operate the operation member 53, the connection member 55 maintains a contact state with the lower surface of the body extension 513 and the upper surface of the support 533. In addition, as shown in FIG. 14, the operation part 532 of the operation member 53 may protrude downward from the lower surface of the sub-door 40, that is, the cap decoration 442. Accordingly, the user may easily approach the operation member 53 when touching the edge of the sub-door 40.

To open the sub-door 40, the user may press the operation part 532 in an exposed state. When the operation part 532 is pressed, the operation member 53 rotates counterclockwise (in FIG. 14) around the operation member rotation shaft 531*a*.

By rotation of the operation member 53, the support 533 is brought into contact with the lower end of the connection member 55, that is, the lower cap 553, to push the connection member 55 upward. By the support 533, the connection member 55 moves upward and, in this process, the lower spring 554 disposed between the connection member support 533 and the lower cap 553 may be compressed.

When the connection member 55 moves upward, the upper end of the connection member 55, that is, the upper cap 552, pushes the body extension 513 of the locking member 51 upward from the lower side. By the connection member 55, the locking member 51 rotates clockwise (in FIG. 13) around the locking member rotation shaft 524. In addition, as the locking member 51 rotates clockwise, the upper spring 518 may be stretched.

When the locking member 51 rotates, the locking hook 514 and the locking protrusion 332 may be separated from each other to be unlocked, and the sub-door 40 is openable, when the sub-door 40 is unlocked, the user may operate the operation part 532 and, at the same time, hold the handle groove 444 adjacent to the operation part 532 to rotate the sub-door 40, such that the sub-door 40 is opened.

Meanwhile, when the hand pressing the operation part 532 is released after opening the sub-door 40, the lower spring 554 is restored to an initial state and, by elastic force at this time, the operation member 53 rotates clockwise (in FIG. 14) and returns to the initial position.

At the same time, the upper spring 518 is restored to the initial state and, by elastic force at this time, the locking member 51 rotates counterclockwise (in FIG. 13) and returns to the initial position. In the process in which the operation member 53 and the locking member return to the initial position, the connection member 55 may move downward.

Meanwhile, when the sub-door 40 is closed in a state in which the sub-door 40 is opened, although separate operation is not performed, in a process of inserting the end of the locking member 51 into the locker 331, the locking member 51 rotates such that the locking hook 514 and the locking protrusion 332 are locked to each other and the sub-door 40 may be maintained in the closed state.

The refrigerator and the refrigerator door according to the proposed embodiments may have the following effects.

According to the embodiment of the present disclosure, an opening/closing assembly for selective opening/closing of the door is provided inside the door, and an operation member which is a component of the opening/closing assembly is disposed at the lower end of the door. It is possible to easily open the door by operating the operation member.

The operation member is disposed at the lower end of the door so as not to impair the appearance of the front surface of the door. In particular, when the front surface of the door is formed of a material such as glass or metal, it is possible to easily process the front surface of the door and to improve appearance.

In addition, the opening/closing member may include a connection member connecting the locking member and the operation member vertically separated from each other, and the connection member may have a structure accommodated in the connection member case. In this case, the connection member and the connection member case have a vertically long shape.

The connection member case has the same internal cross-sectional structure vertically and thus the long connection member is a single component and may be extruded. Accordingly, formability of the connection member case is easy and assembly workability is improved.

In addition, the vertically long connection member case may be formed with a reinforcement part in the vertical direction. Accordingly, it is possible to prevent the connection member case elongated vertically as a single component from being deformed. In particular, by preventing the vertically long connection member case from being deformed by pressure of a heat insulating member injected into the door when processing the door, it is possible to ensure accurate operation of the opening/closing assembly.

In addition, the reinforcement part has a structure protruding in an accommodation space in which the connection member is accommodated, and a rod guide protrudes from a rod configuring the connection member. Therefore, while the connection member moves, the rod is not in contact with the entire inner surface of the connection member case but is partially in contact with the reinforcement part, thereby minimizing friction with the connection member and ensuring stable operation.

In addition, the reinforcement part may be formed outside the connection member case, and a surface facing the panel assembly may be rounded. When the heat insulating material is injected into the door, it is distributed in contact with the reinforcement part, thereby minimizing pressure applied to the connection member case.

In addition, the upper end of the connection member case is inserted into the upper mounting part formed at the lower surface of the locking member accommodation part, and the lower end of the connection member case is inserted into the lower mounting part formed at the upper surface of the operation member accommodation part to be firmly fixed to the inside of the sub-door. When the heat insulating material is injected into the door, the position of the connection member case may be maintained and the heat insulating material may be prevented from flowing into the connection member case.

In addition, the door liner may be further formed with a case fixing part locking both sides of the connection member case, and a plurality of case fixing parts may be formed along the connection member case, thereby maintaining a state in which the connection member case is firmly mounted on the door liner. Accordingly, even if the heat insulating material is injected into the door, the connection member can be maintained in a firmly mounted state.

In addition, soft upper and lower caps are formed at the upper and lower ends of the connection member, which may be in contact with the locking member and the operation member. Accordingly, it is possible to prevent impact generated in a process of operating the opening/closing assembly and noise caused by impact and to further improve feeling of operation of the operation member.

What is claimed is:

1. A refrigerator comprising:

a cabinet that defines a storage space;

a main door rotatably coupled to the cabinet and configured to open and close at least a portion of the storage space, an opening being defined through the main door in a front-rear direction;

a sub-door rotatably disposed at a front side of the main door and configured to open and close the opening of the main door;

a heat insulating material injected into the sub-door;

a locking member that protrudes from the sub-door to the main door and is configured to couple to the main door;

an operation member that is disposed below the locking member and that protrudes downward relative to a lower portion of the sub-door, the operation member being configured to be operated by a user;

a connection member that connects the operation member to the locking member and enables the locking member to operate based on the user operating the operation member; and a connection member case that is disposed in the heat insulating material inside the sub-door and defines an internal space that accommodates the connection member, wherein the connection member case comprises a reinforcement part that extends along the connection member case, the reinforcement part extending from an upper end of the connection member case to a lower end of the connection member case, and wherein the reinforcement part is in contact with the heat insulating material and configured to restrict the connection member case from being deformed by pressure generated in a process of injecting the heat insulating material into the sub-door.

2. The refrigerator of claim 1, wherein the connection member case surrounds an outer circumferential surface of the connection member, wherein the upper end of the connection member case defines an upper opening, and the lower end of the connection member case defines a lower opening, and wherein an upper end of the connection member passes through the upper opening of the connection member case, and a lower end of the connection member passes through the lower opening of the connection member case.

3. The refrigerator of claim 1, wherein a width of the internal space of the connection member case is greater than an outer diameter of the connection member.

4. The refrigerator of claim 3, wherein the reinforcement part comprises an inner reinforcement part that is disposed at and extends along an inner surface of the connection member case.

5. The refrigerator of claim 4, wherein the inner reinforcement part is one of a plurality of inner reinforcement parts that protrude from the inner surface of the connection member case toward an outer surface of the connection member.

6. The refrigerator of claim 4, wherein the reinforcement part further comprises an outer reinforcement part that protrudes from an outer surface of the connection member case.

7. The refrigerator of claim 1, wherein a circumferential surface of the connection member case has a polygonal shape and is in contact with an inner surface of the sub-door, and wherein the reinforcement part has a curved shape and protrudes from the circumferential surface toward a front surface of the sub-door.

8. The refrigerator of claim 7, wherein the sub-door comprises a plurality of case fixing parts that protrude from the inner surface of the sub-door, that are separated from one another, and that support sides of an outer surface of the connection member case.

9. The refrigerator of claim 1, wherein the sub-door defines:

a locking member accommodation part that is recessed from a rear surface of the sub-door and accommodates at least a portion of the locking member; and an operation member accommodation part that is recessed from a lower surface of the sub-door and accommodates at least a portion of the operation member, and wherein the connection member case passes through a lower part of the locking member accommodation part and an upper part of the operation member accommodation part.

10. The refrigerator of claim 9, further comprising:

an upper mounting part that is in contact with an upper circumference of the connection member case, the upper mounting part being disposed at a lower surface of the locking member accommodation part; and a lower mounting part that is in contact with a lower circumference of the connection member case, the lower mounting part being disposed at an upper surface of the operation member accommodation part.

11. The refrigerator of claim 1, wherein a cross-sectional shape of the upper end of the connection member case is identical to a cross-sectional shape of the lower end of the connection member case.

12. The refrigerator of claim 11, wherein the connection member case and the reinforcement part are made of a plastic material and manufactured together through an extrusion process.

13. The refrigerator of claim 1, further comprising:

a locking member bracket that is disposed in the sub-door and rotatably supports the locking member thereon; and a locking member spring that connects the locking member to the locking member bracket and is configured to provide elastic force to the locking member based on rotation of the locking member relative to the locking member bracket.

14. The refrigerator of claim 1, further comprising a connection member spring that surrounds at least a portion of the connection member and is configured to provide elastic force to the operation member or the connection member based on operation of the operation member.

15. The refrigerator of claim 1, wherein the connection member has a rod shape extending vertically in an up-down direction, wherein a lower end of the connection member is in contact with the operation member and configured to vertically move based on a rotation operation of the operation member, and wherein an upper end of the connection member is in contact with the locking member and configured to rotate the locking member based on a vertical movement of the connection member.

16. The refrigerator of claim 15, further comprising:

an upper cap that is coupled to the upper end of the connection member and in contact with the locking member; and a lower cap that is coupled to the lower end of the connection member and in contact with the operation member, wherein a hardness of each of the upper cap and the lower cap is less than a hardness of any of the connection member, the locking member, and the operation member.

17. The refrigerator of claim 1, wherein the connection member comprises:

a rod that vertically extends in an up-down direction; and a rod guide that extends along a circumference of the rod and protrudes toward an inner surface of the connection member case.

18. The refrigerator of claim 17, wherein the rod guide has a ring shape, and the rod passes through the rod guide, and wherein the rod guide is one of a plurality of rod guides that are arranged along the rod.

19. The refrigerator of claim 17, wherein the rod is made of a metal material, and the rod guide is made of a material different from the metal material of the rod.

20. The refrigerator of claim 1, wherein the sub-door defines a handle groove that is recessed from a lower surface of the sub-door and disposed at a position adjacent to the operation member, the handle groove being configured to receive a hand of the user therein to thereby allow the user to pull open the sub-door.

* * * * *